US005192029A

United States Patent [19]

Harris

[11] Patent Number: 5,192,029

[45] Date of Patent: Mar. 9, 1993

[54] GYROSCOPIC CENTRIFUGE AND MILL APPARATUS AND METHOD OF USE FOR TREATMENT OF SOLID WASTE PRODUCTS

[75] Inventor: Curtis L. Harris, Denver, Colo.

[73] Assignee: Universal Entech, A Colorado Corporation, Englewood, Colo.

[21] Appl. No.: 473,901

[22] Filed: Feb. 5, 1990

[51] Int. Cl.[5] ..... B02C 13/09

[52] U.S. Cl. ..... 241/27; 241/154; 241/188.1; 241/192; 241/275

[58] Field of Search ..... 241/186.2, 82, 56, 154, 241/186 R, 188 R, 192, 275, 27

[56] References Cited

U.S. PATENT DOCUMENTS

| | | | |
|---|---|---|---|
| 1,669,239 | 5/1928 | Grindle | 241/82 X |
| 1,798,465 | 3/1931 | Grindle | 241/82 X |
| 2,639,747 | 5/1953 | Burn et al. | 241/192 X |
| 3,987,970 | 10/1976 | Burkett | 241/186.2 |
| 4,151,794 | 5/1979 | Burkett | 241/275 X |
| 4,690,338 | 9/1987 | Sayler et al. | 241/154 X |
| 4,989,796 | 2/1991 | Eide | 241/154 |
| 5,067,661 | 11/1991 | Eide | 241/275 X |

FOREIGN PATENT DOCUMENTS

| | | | |
|---|---|---|---|
| 384236 | 4/1908 | France | 241/82 |
| 688523 | 3/1953 | United Kingdom | 241/192 |

*Primary Examiner*—Mark Rosenbaum
*Assistant Examiner*—Kenneth J. Hansen
*Attorney, Agent, or Firm*—Phillip A. Rein

[57] ABSTRACT

This invention relates to a gyroscopic centrifuge and mill apparatus having 1) a main mill housing assembly; 2) a material impact means mounted within the main mill housing assembly; and 3) a material conveyor means operable to a) convey raw waste/trash material thereto; b) convey heavy infraction materials initially processed outwardly from the main mill housing assembly; and c) convey the finally processed waste/trash material laterally of the main mill housing assembly. The material impact means is provided with a plurality of spaced adjustable impact blade assemblies mounted on a main upright driven shaft member and being associated with respective separator shelf assemblies in separate waste treatment zones. The impact blade assemblies have striker blade members which can be adjusted inwardly and outwardly, reversed due to wear conditions, and can have an angular relationship to a horizontal plane adjustable so as to regulate the volume and velocity of air flow through the entire main mill housing assembly. Each separator shelf asssembly includes a separator ring means with a central access opening which can change in diameter to control the flow and processing of the waste/trash material therethrough. The gyroscopic centrifuge and mill apparatus further includes a heavy infraction discharge assembly having an impact discharge assembly at the initial treatment zone to impell heavy infraction material outwardly to a portion of the material conveyor means. The heavy infraction discharge assembly operates to remove the heavy metal type materials initially in the processing steps to lessen wear and tear on the material impact means in the remaining treatment zones.

20 Claims, 4 Drawing Sheets

GYROSCOPIC CENTRIFUGE AND MILL APPARATUS AND METHOD OF USE FOR TREATMENT OF SOLID WASTE PRODUCTS

PRIOR ART

A specific patent search drawn to numerous features of the invention disclosed herein was not conducted. However, the applicant herein has had considerable experience in regard to the treatment of solid waste products through the use of a centrifuge mill apparatus, pulverizer structures for treatment of rock masses, comminution devices, and is familiar with the following United States Patents:

| Patent No. | Invention | Inventor |
|---|---|---|
| 3,160,354 | COMMINUTION DEVICE | Albert Le Roy Burkett |
| 3,065,919 | ORE CONCENTRATOR | Burkett et al |
| 3,987,970 | CENTRIFUGAL MILL | Albert L. Burkett |
| 4,144,167 | SEWAGE TREATMENT SYSTEM | Burkett et al |
| 4,151,794 | APPARATUS FOR TREATING ORGANIC MATERIALS | Albert L. Burkett |
| 4,493,459 | MULTI-PURPOSE CENTRIFUGAL MILL | Albert L. Burkett |

The Burkett U.S. Pat. No. 3,160,354 discloses a comminution device having a plurality of stacked rotor plates to engage mineral bearing rock to pulverize same and freeing the minerals therefrom.

The Burkett et al. U.S. Pat. No. 3,065,919 discloses an ore concentrator to crush sedimentary rocks and remove minerals therefrom by the use of throwing plates.

The Burkett U.S. Pat. No. 3,987,970 discloses a centrifugal mill for treating refuse material using a prebreaker mechanism to initially open bags, cartons, and the like. A plurality of comminution means are mounted on a central drive shaft to provide separate steps in processing the refuse material.

The Burkett et al. U.S. Pat. No. 4,144,167 discloses a sewage treatment system using a centrifugal mill as noted in FIGS. 5 and 6 but used on liquid/solid waste.

The Burkett U.S. Pat. No. 4,151,794 discloses a centrifugal mill to treat organic materials using an air and/or liquid medium. A shelf structure is associated with respective comminution means.

The Burkett U.S. Pat. No. 4,493,459 discloses a multipurpose centrifugal mill having a pre-grinder means associated with stacked rotor means having refuse striker bars.

PREFERRED EMBODIMENT OF THE INVENTION

In one preferred embodiment of this invention, a gyroscopic centrifuge and mill apparatus is operable to continuously receive solid waste/trash material for processing by impacting, shredding, grinding, and pulverizing into predetermined sizes and material types for further recycling processing. The gyroscopic centrifuge and mill apparatus includes 1) a main mill housing assembly or means; 2) a material impact means mounted within the main mill housing assembly; and 3) a material conveyor means operable to 1) convey the waste/trash refuse material to the main mill housing assembly; and 2) transporting the processed waste material therefrom. The main mill housing assembly resembles a grain storage bin having 1) a bottom support assembly to be mounted on a support surface; 2) a side wall panel assembly secured to, and extended upwardly from, the bottom support assembly; and 3) a top wall assembly mounted about an upper portion of the side wall assembly. The side wall assembly is provided with interconnected side panels and an access door assembly for selective entrance thereto for repair and maintenance. The top wall assembly includes a top wall member having a material inlet opening and a central shaft opening to receive and support a portion of the material inpact means. The material impact means includes 1) a plurality of spaced impact blade assemblies; 2) a separator shelf assembly associated with respective ones of the impact blade assemblies; and 3) a main power supply assembly having a central main driven shaft member to which the impact blade assemblies are interconnected. Each impact blade assembly is provided with 1) a taper lock bushing assembly interconnected to the main drive shaft member; 2) a main blade support plate connected to the taper lock bushing assembly; and 3) a striker blade assembly adjustably mounted on the main blade support plate. The respective taper lock bushing assemblies allow for vertical adjustable movement of respective impact blade assemblies on the main driven shaft member to provide variation in grinding capabilities. Each striker blade assembly includes a plurality of equally spaced blade mounting assemblies connected to a respective main blade support plate, each having a striker blade member adjustably mounted thereon. The striker blade members can be constructed of various lengths having a connector section connected to the blade mounting assembly and integral with an outer impeller section. The impeller section can be mounted at different angles of inclination by use of different blade mounting assemblies so as to control and regulate air flow volume and velocity moving through the main mill housing assembly. Each striker blade member is reversible due to wear of the impeller section which then becomes the connector section to double the usage life thereof. A respective separator shelf assembly is operably associated with respective ones of the impact blade assemblies so as to achieve the desired grinding and separation of the waste/trash material moving therethrough. Each separator shelf assembly is provided with a separator ring member connected by a shelf connector assembly to an inner wall of the side wall assembly of the main mill housing assembly. The separator shelf assemblies are provided with vertical adjustability of mounting to the main mill housing assembly and, furthermore, has a central access opening which can be of various diameters. It is noted that the use of the striker blade members of various lengths in conjunction with their vertical adjustment on the main driven shaft member and in conjunction with the central opening in the adjacent separator shelf assembly provides for the new, novel, and adjustable features of the material impact means of this invention. A lowermost one of the impact blade assemblies is provided with the taper lock bushing assembly having the main blade support plate and the striker blade assembly connected thereto. In this case, the spaced striker blade members are extended horizontally and secured directly to the main blade support plate. This lowermost impact blade assembly operates to receive and impact the waste/trash material and move same outwardly under centrifical force in conjunction with the air flow for discharge through the discharge opening in one of the side panel members and deposited on a conveyor assembly of the material conveyor means. The main power supply assembly includes a power drive assembly interconnected through a belt and pulley assembly to a main power shaft assembly which includes the driven shaft member. The power drive assembly includes an electrical motor member operable to rotate the driven shaft member and the material impact means connected thereto. The material conveyor means includes 1) a refuse inlet conveyor assembly; 2) a heavy infraction discharge assembly; and 3) a material discharge conveyor assembly. The refuse inlet conveyor assembly includes a conveyor belt member having an upper belt support surface to convey the refuse/waste material through a material inlet opening into the main mill housing assembly. The heavy infraction discharge assembly includes an impact discharge assembly associated with a discharge conveyor assembly. The impact discharge assembly includes an impact housing assembly mounted on an outer upper portion of the main mill housing assembly adjacent the uppermost material impact blade assembly and having associated therewith an impingement flap assembly. The impingement flap assembly includes a main flap member secured across an upper discharge opening into the impact housing assembly and constructed of a resilient rubber material. The impact housing assembly is of generally U-shape adapted to receive heavy materials impacted through the impingement flap assembly which then moves under gravity downwardly onto the discharge conveyor assembly. The heavy material is then moved laterally by the discharge conveyor assembly for further waste treatment. The material discharge conveyor assembly is substantially identical to the previously described discharge conveyor assembly but is associated with a discharge opening in a lower portion of the side wall assembly of the main mill housing assembly. The processed waste/-trash material is moved outwardly of the main mill housing assembly by 1) centrifical force and impaction by the lowermost impact blade assembly; and 2) the air flow created by the inclined, rotating striker blade members. This finally processed waste/trash material is placed on the material discharge conveyor assembly for continuous automatic conveyance therefrom.

The method of use of the gyroscope centrifuge and mill apparatus of this invention includes the steps of 1) supplying an inlet waste/trash material to an upper inlet opening into the main mill housing assembly; 2) allowing for an inlet air flow with the inlet waste/trash material through the upper inlet opening; 3 rotating a material impact means within the main mill housing assembly in a plurality of stacked waste treatment zones; 4) impacting heavy infraction materials in a first treatment zone for removal therefrom through a heavy infraction discharge assembly; 5) impacting and reducing in size of the remaining waste/trash material as it moves downwardly through the other waste/trash treatment zones; and 6) removing and conveying the treated waste/trash material through a discharge opening in the main mill housing assembly for further separation, treatment, and use thereof. The method of use may also include the steps of 1) adjusting the material impact means and, more specifically, the vertical distance between a separator shelf assembly and an adjacent impact blade assembly; 2) adjusting the lengths of striker blade members in each impact blade assembly; 3) adjusting the inclination of the striker blade members relative to a horizontal plane to act as impeller blades to regulate the air flow volume and velocity through the main mill housing assembly; and 4) regulating the rotation speed of the material impact means relative to the inlet air flow and supply of the inlet waste/trash material to achieve the desired finished processed material at the discharge point from the main mill housing assembly.

OBJECTS OF THE INVENTION

One object of this invention is to provide a gyroscopic centrifuge and mill apparatus having a new and novel material impact means provided with 1) impact blade assemblies which are adjustably mounted vertically on a main driven support shaft; and 2) each impact blade assembly having striker blade members which can be adjustable in length, inclination, and vertical positioning in order to selectively control movement of the waste/trash material therethrough and the air flow to regulate the final size and condition of the treated waste/trash material to be received therefrom.

Another object of this invention is to provide a gyroscopic centrifuge and mill apparatus having a material impact means mounted within a main mill housing assembly, the material impact means includes material striker blade members respectively associated with a separator shelf assembly which can be adjusted vertically relative to adjust control of the air flow and treating of the waste/trash material that moves therethrough.

One other object of this invention is to provide a gyroscopic centrifuge and mill apparatus having 1) a main mill housing assembly; 2) a material impact means mounted within the main mill housing assembly to contact and treat inlet waste/trash material moving therethrough; and 3) a material conveyance means having a refuse inlet conveyor assembly to feed waste material into the main mill housing assembly, a heavy infraction discharge assembly operable to initially impact heavy products to discharge same at an initial point of processing the waste/trash material, and a material discharge assembly connected to a lower end of the main mill housing assembly to receive and remove the processed waste material therefrom.

One further object of this invention is to provide a gyroscopic centrifuge and mill apparatus including a material impact means mounted within a main mill housing assembly, the material impact means having adjustable impact blade assemblies and cooperating separator shelf assemblies so as to control the movement of waste/trash material therethrough within separate treatment zones, and having adjustable features so that the amount of processing to be obtained on the waste/trash material in each treatment zone can be adjusted.

One other object of this invention is to provide method steps of treating waste/trash material including 1) providing the waste/trash material with an internally created air flow into a top portion of a main mill housing assembly; 2) rotating a material impact means within the main mill housing assembly to achieve separate waste/trash material treatment zones, each having an impact blade assembly therein; 3) adjusting the length, vertical positioning, and inclination of striker blade members in each impact blade assembly to adjust and regulate processing of the waste/trash material in each treatment zone; and 4) removing the finally processed waste/trash material laterally and automatically from the main mill housing assembly. The method of use of the gyroscopic centrifuge and mill apparatus further includes a step of initially impacting and removing heavy materials of waste/trash material laterally of the main mill housing assembly Still, one other object of this invention is to provide a gyroscopic centrifuge and mill apparatus which is sturdy in construction; reliable in operation; readily adjustable to achieve various degrees of waste/trash material processing throughout separate treatment zones; automatic and continuous in operation; and being substantially maintenance free.

Various other objects, advantages, and features of the invention will become apparent to those skilled in the art from the following discussion, taken in conjunction with the accompanying drawings, in which:

FIGURES OF THE INVENTION

Figures 1, 3:
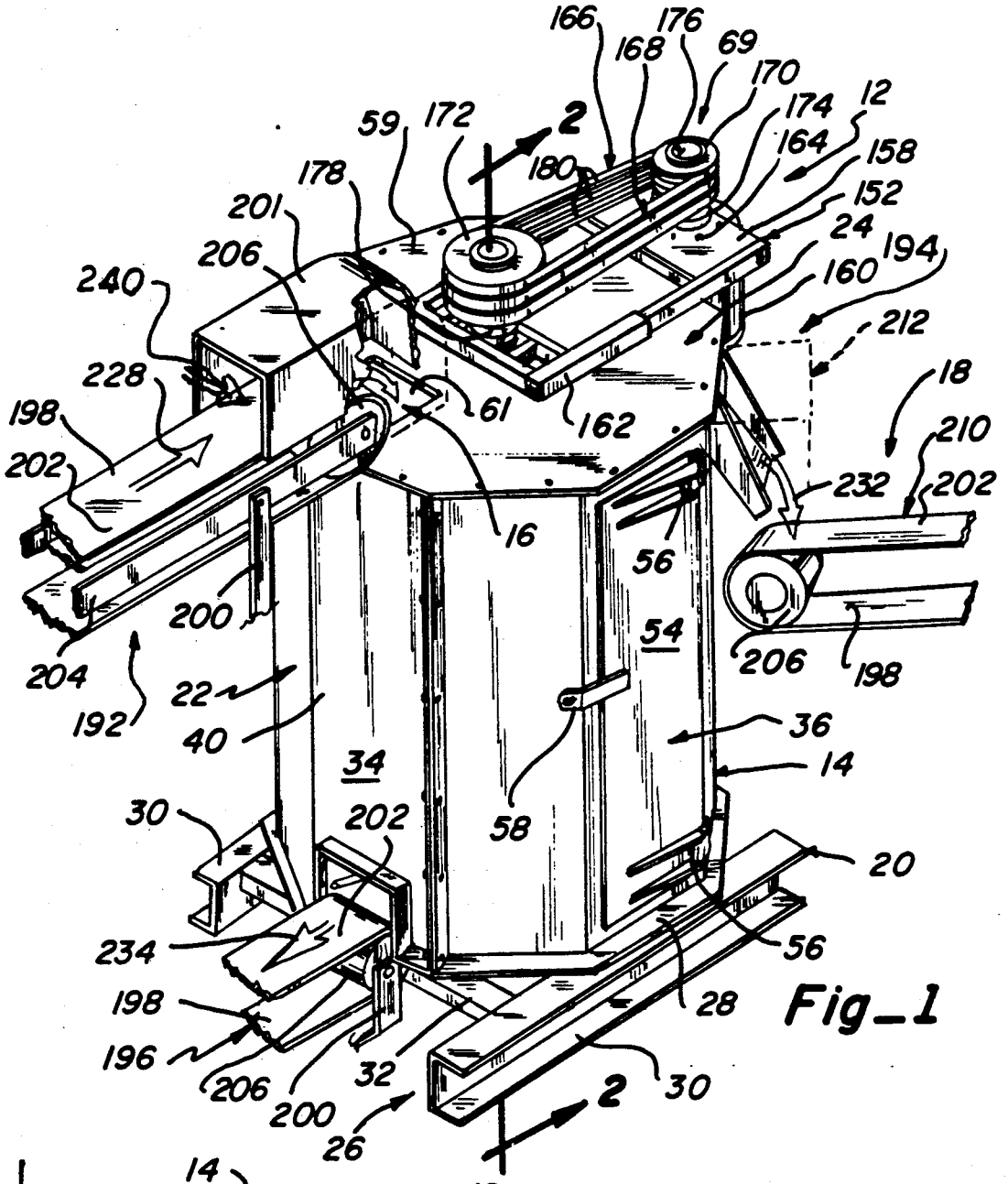
FIG. 1 is a fragmentary perspective view of a gyroscopic centrifuge and mill apparatus of this invention illustrating a material conveyor means utilized to supply waste/trash material thereto for treatment and convey the processed waste/trash material therefrom.
FIG. 3 is a fragmentary sectional view taken along line 3—3 in FIG. 2 illustrating details of a heavy infraction discharge assembly.

The following is a discussion and description of preferred specific embodiments of the gyroscopic centrifuge and mill apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in details and, in particular to FIG. 1, a gyroscopic centrifuge and mill apparatus of this invention, indicated generally at 12, is utilized to accept and process a waste/trash material which may be a combination of glass, plastic, paper, metals, and other materials which are presented for processing, treatment, separation, and subsequent possible use in a recycling operation.

The gyroscopic centrifuge and mill apparatus 12 is operable to receive the raw waste/trash material for processing through various steps of material treatment to achieve desirable end products to be moved through the use of conveyor assemblies for further use and/or treatment thereof.

The gyroscopic centrifuge and mill apparatus 12 includes 1) a main mill housing assembly 14 to rest on a support surface; 2) a material inpact means 16 mounted within the main mill housing assembly 14 to contact and treat the incoming waste/trash material; and 3) a material movement or conveyor means 18 operably associated with the main mill housing assembly 14 to first convey the waste/trash material thereto and, subsequently, convey various light and heavy fractions of the processed waste/trash material therefrom as will be noted.

The main mill housing assembly 14, which resembles a multi-sided grain storage bin, includes 1) a bottom support assembly 20 to mount on the support surface; 2) a side wall assembly 22 connected to the bottom support assembly 20; and 3) a top wall assembly 24 mounted on and sealed with an upper peripheral edge of the side wall assembly 22. The bottom support assembly 20 includes a support beam assembly 26 having a bottom wall member 28 mounted thereon.

As noted in FIG. 1, the support beam assembly 26 is provided with parallel outer beam members 30 of a generally U-shape in transverse cross section interconnected by transverse beam members 32. This provides for rigid support to the overall main mill housing assembly 14 and permits the gyroscopic centrifuge and mill apparatus 12 to be moved to an off-site location to achieve a portable temporary installation.

The bottom wall member 28 has a central shaft opening 29 to receive a portion of the material impact means 16 therethrough in a manner to be explained.

The side wall assembly 22 includes 1) a plurality of interconnected side panel members 34 forming two (2) half sections 35, each consisting of an equal number of side panel members 34; 2) an access door assembly 36 mounted in one of the side panel members 34; and 3) a connector assembly 38 operable to interconnect the side panel members 34.

The side panel members 34 are each of a rectangular shape having a main body section 40 with an upper portion 42, a lower portion 44, and a side portion 46. One of the side panel members 34 is provided with a door access opening 48; another side panel member 34 is provided with an upper discharge opening 50; and another side panel member 34 is provided with a lower discharge opening 52 for reasons to be explained.

The access door assembly 36 includes an access door 54 which is interconnected about the door opening 48 by hinge members 56 and held in a closed condition, as noted in FIG. 1, by a latch member 58. The access door assembly 36 is operable so that ready access can be gained to the interior of the main mill housing assembly 14 for repair and maintenance purposes.

Figure 6:
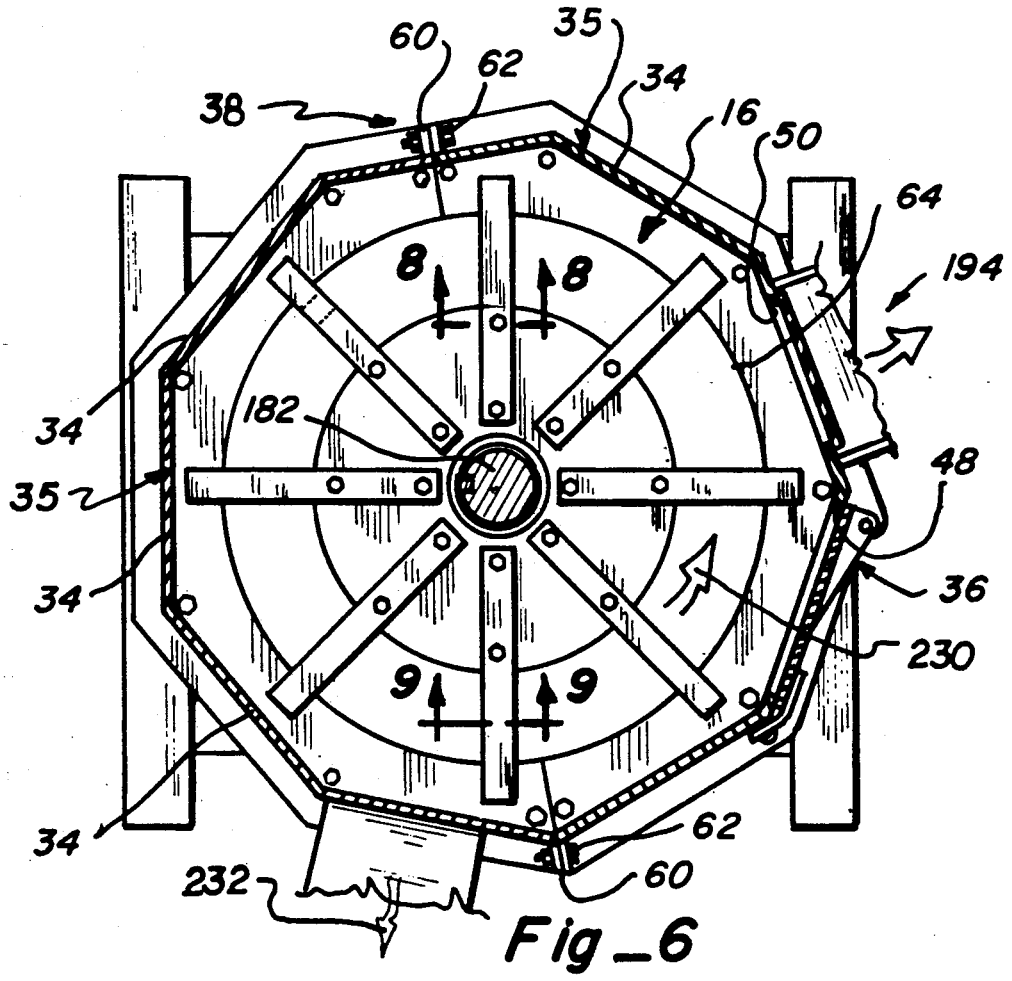
FIG. 6 is a sectional view taken along line 6—6 in FIG. 2.

The connector assembly 38 includes flange members 60 interconnected to each other by nut and bolt members 62 to hold in the condition as noted in FIG. 6. It is seen that the side panel members 34 are formed in the half sections 35 and interconnected through the flange members 60 and nut and bolt members 62.

The top wall assembly 14 includes a main top wall member 59 having a material inlet opening 61 and a central control shaft opening 63. The material inlet opening 61 is operable to receive and direct the inlet waste/trash material into the main mill housing assembly 14.

The central shaft opening 63 is to receive a portion of a main driven shaft member of the material impact means 16 as will be explained.

Figure 2:
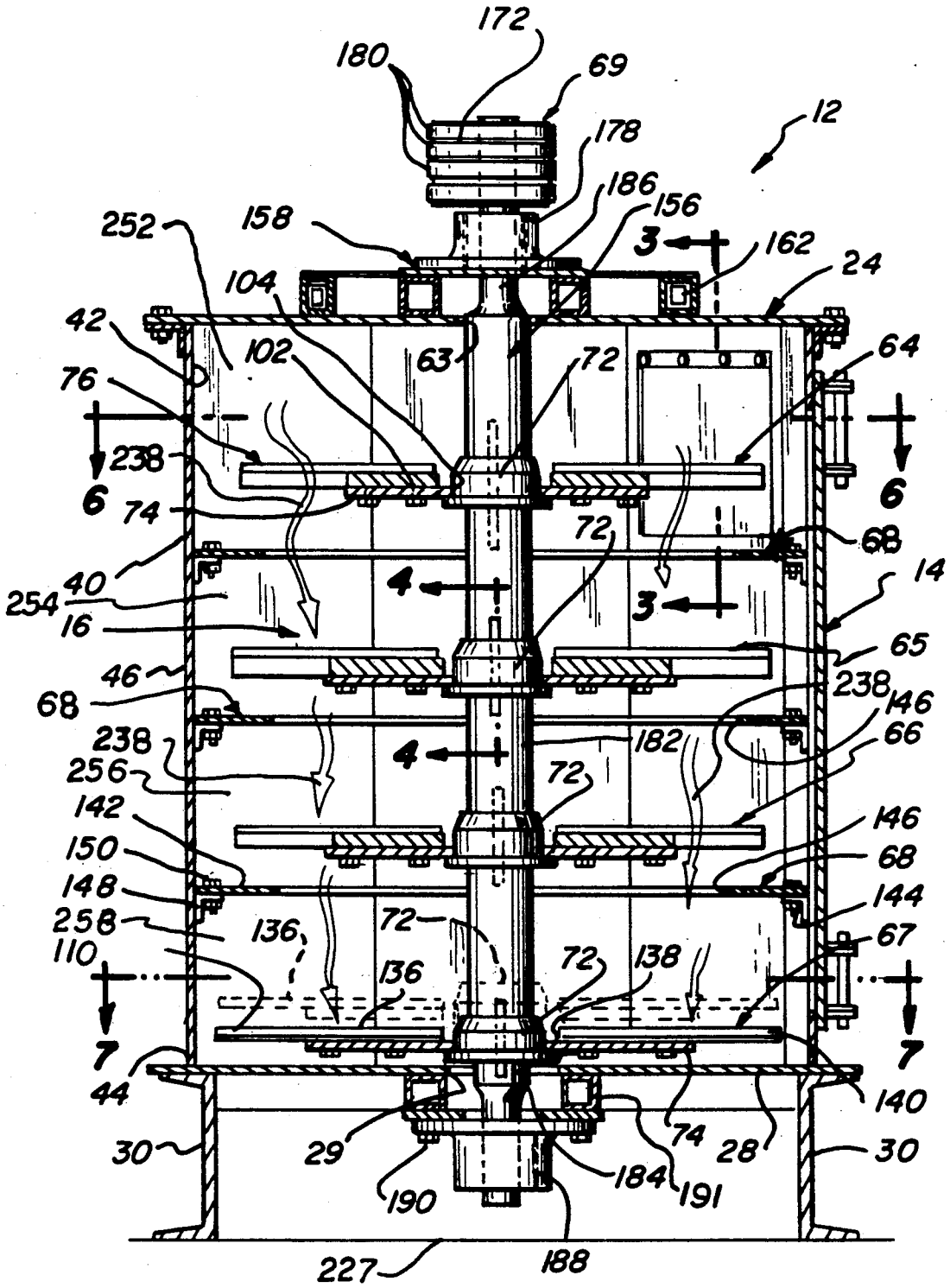
FIG. 2 is an enlarged fragmentary sectional view taken along line 2—2 in FIG. 1.

As noted in FIG. 2, the material impact means 16 includes 1) a plurality of spaced stacked impact blade assemblies 64, 65, 66, 67; 2) a plurality of separator shelf assemblies 68 being associated with the respective impact blade assemblies 64, 65, and 66; and 3) a main power supply assembly 69.

The impact blade assemblies 64, 65, 66, 67 are substantially identical except variation in some size relationships and deletion of some blade mounting parts, each having 1) a main taper lock bushing assembly 72 operable to be adjustably connected to the main driven shaft member as will be explained; 2) a main blade support plate 74 secured to the taper lock bushing assembly 72; and 3) a plurality, namely eight (8), striker blade assemblies 76 interconnected to an upper surface of the main blade support plate 74.

The taper lock bushing assembly 72 is known in the prior art and does not present an independent patentable feature of this application. Each taper lock bushing assembly 72 includes an outer housing member 78 having an inner taper member 80 connected to each other by a bushing connector assembly 82 and interconnected by a shaft anchor assembly 81 to the main driven shaft member.

Figure 4:
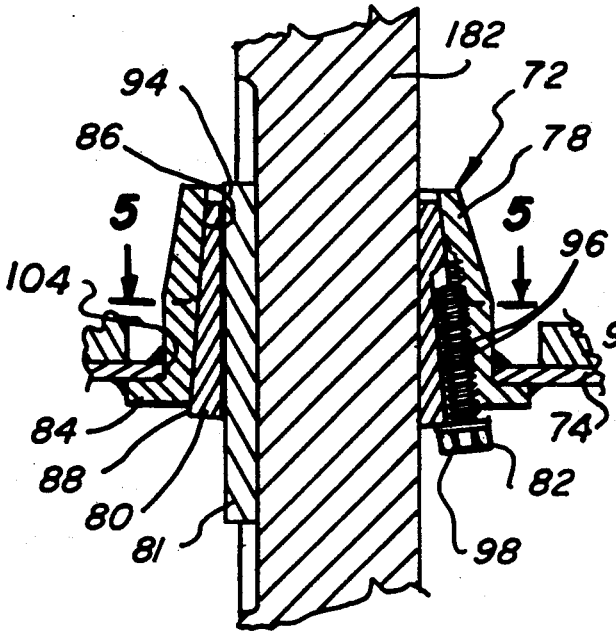
FIG. 4 is an enlarged fragmentary sectional view taken along line 4—4 in FIG. 2.
Figure 5:
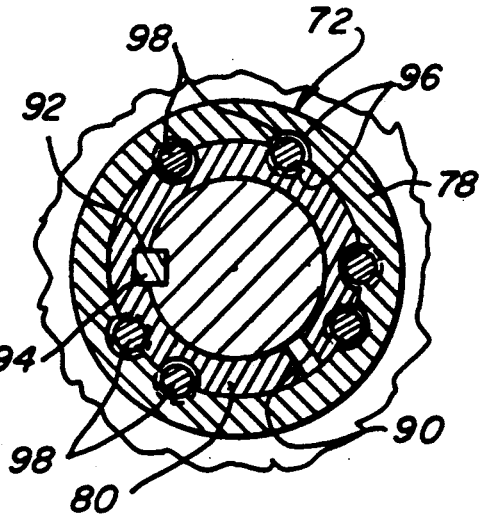
FIG. 5 is a fragmentary sectional view taken along line 5—5 in FIG. 4.

As noted in FIG. 4, the outer housing member 78 has a support ledge section 84 and an inner tapered opening 86. The support ledge section 84 is to support the main blade support plate 74 thereon.

The inner taper member 80 has an outer taper surface 88 to fit within the inner tapered opening 86 and having a slot section 90. The slot section 90 allows for the expansion and contraction of the entire inner taper member 80 which acts as a ring member to provide a cam lock feature for locking onto the main driven shaft member in a manner to be explained.

The shaft anchor assembly 81 includes a key way slot 92 to receive a key member 94 therein for conjoint rotation with the main driven shaft member.

The bushing connector assembly 82 includes half threaded openings 96 in both the outer housing member 78 and the inner taper member 80 operable to receive bushing bolt members 98 therein. It is noted that the bushing bolt members 98 are rotatable within the respective half threaded openings 96 to achieve a rigid locking feature of the entire taper lock bushing assembly 72 about the main driven shaft member and, concurrently, contacts and grips the key member 94 in the key way slot 92 to prevent relative rotational movement therebetween.

The existence of the taper lock bushing assemblies 72 is well known in the prior art and provides a heavy duty locking feature. Use of the taper lock bushing assemblies 72 in this invention permits independent axial vertical adjustment movement of the respective impact blade assemblies 64, 65, 66, 67 as noted in dotted lines illustrating movement of the impact blade assembly 67 in FIG. 2.

The main blade support plate 74 associated with each one of the four (4) spaced taper lock bushing assemblies 72, respectively, includes a main plate body 102 having a central connector opening 104 and spaced blade or striker bar connector holes 106 thereon. The central connector opening 104 is placed about the outer housing member 78 and secured to the support ledge section 84 as by welding as noted in FIG. 4.

The blade connector holes 106 are noted in FIG. 8 and operable to receive connector bolt members for attachment to the striker blade assemblies 76 as will be explained.

Each striker blade assembly 76 includes 1) a blade mounting assembly 108; and 2) a striker blade member 110 connected to the blade mounting assembly 108.

Each blade mounting assembly 108 includes a blade support block 112 and a blade connector assembly 114 to attach same to the respective main blade support plate 74.

The blade support block 112 is generally of a triangular shape in transverse cross section having 1) a main block body 116, 2) a plurality of spaced plate anchor holes 118; and 3) blade anchor holes 120.

Figure 8:
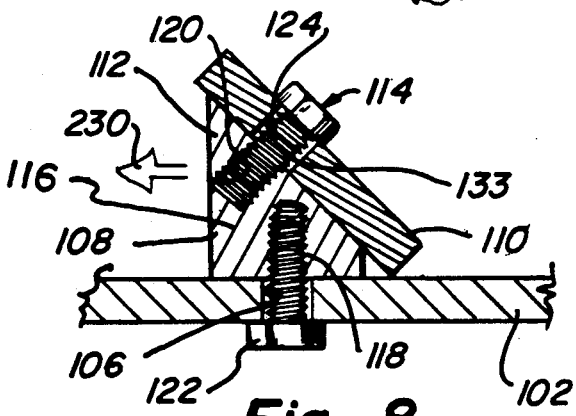
FIG. 8 is an enlarged fragmentary sectional view taken along line 8—8 in FIG. 6.

As noted in FIG. 8, the blade connector assembly 114 includes plate bolt members 122 inserted through the blade connector holes 106 in the main plate body 102 and into the plate anchor holes 118 in the main block body 116. Furthermore, the blade connector assembly 114 includes blade bolt members 124 which are mounted into the blade anchor holes 120 in the blade support block 112 for anchoring the respective striker blade members 110 thereto.

The striker blade members 110 are each provided with a main blade body 126 having a connector section 128 integral with an impeller section 130. The connector section 128 is provided with a plurality of spaced anchor holes 133 to receive the blade bolt members 124 therethrough as noted in FIG. 8 to hold in a selected anchored condition.

The various connector holes 106, anchor holes 118, blade anchor holes 120, and anchor holes 133 are placed in proper spaced relationships so that the striker blade members 110 can be reversed 180 degrees lengthwise and anchored to the main plate body 102 for reasons to be explained.

Figure 9:
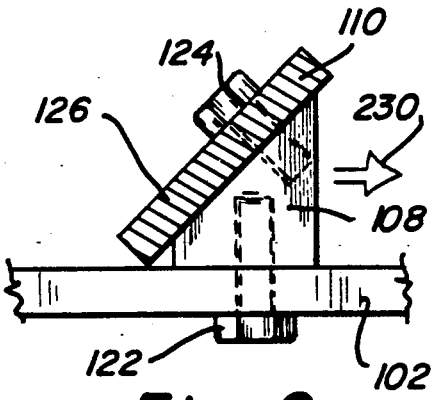
FIG. 9 is an enlarged fragmentary sectional view taken along line 9—9 in FIG. 6.

The impeller section 130 extends outwardly from the respective blade support blocks 112 as noted in FIGS. 6 and 9. When the striker blade members 110 are reversed, the functions of the connector section 128 and impeller section 130 are then reversed.

Figure 10:
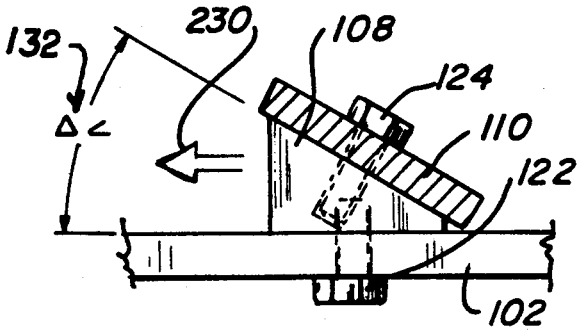
FIG. 10 is a view similar to FIG. 8 illustrating a striker blade member in another angle of inclination.

The striker blade members 110 can be anchored at various angles of inclination as shown by a delta angle 132 in FIG. 10 which is substantially less than the angle utilized for the inclination of the striker blade member 110 in FIG. 8. It is obvious that the greater the inclination of the respective striker blade members 110, the greater amount of area that will act as a fan blade or impeller member to achieve an increased air flow volume and velocity throughout the various levels and treatment zones of the material impact means 16.

It is obvious that if the striker blade members 110 are placed in a flat condition in a horizontal plane, this would provide a horizontal slicing action and would not increase substantially the air flow at a particular treatment zone but would impact and move the waste/trash material horizontally. Conversely, if mounted vertically, the striker blade members 110 would substantially increase air flow and impact the waste/trash material.

The impact blade assembly 67 may have the striker blade members 110 bolted directly to the main blade support plate 74 in a horizontal plane without the blade mounting assemblies 108 being used. These striker blade members 110 contact the processed waste/trash material, whether positioned in horizontal or inclined vertical planes, and fling the same outwardly for discharge through the lower discharge opening 52 onto a portion of the material conveyor means 18 as will be explained.

The striker blade members 110 in the impact blade assembly 67 each have have an outer edge section 140 placed adjacent an inner surface of the side wall assembly 22 of the main mill housing assembly 14 so as to impact the waste/trash material and move the same outwardly through the lower discharge opening 52. An upper surface 136 of each striker blade member 110 is shown in a horizontal plane (can be in an inclined plane) and an end wall 138 is adjacent the respective taper lock bushing assembly 72.

As noted in FIG. 2, there are three of the separator shelf assemblies 68 utilized, all of which are substantially identical, but may have different sizes of central openings to adjustably control the amount of waste/-trash material processing at each separated vertical stage of treatment zones.

Each separator shelf assembly 68 is provided with separator ring members 142 secured as by a shelf connector assembly 144 to an adjacent portion of the inner surface of the main mill housing assembly 14. Each separator ring member 142 is provided with a central access opening 146.

The shelf connector assembly 144 includes an interconnected plurality of angle iron members 148 secured as by nut and bolt members 150 to the respective shelf ring members 142 and secured as by nut and bolt members to the inner surface of the main mill housing assembly 14 so that the separator ring members 142 are vertically adjustable. The shelf ring members 142 can be replaced to provide a central access opening 146 of various sizes cooperating with respective impact blade assemblies 64, 65, and 66.

The main power supply assembly 69 includes 1) a power drive assembly 152 operable to drive the material impact means 16; 2) a belt and pulley assembly 154 connected to the power drive assembly 152; and 3) a main power shaft assembly or drive means 156 connected to another portion of the belt and pulley assembly 154.

The power drive assembly 152 includes a motor support housing 158 mounted about a motor member 160. The motor support housing 158 includes a support frame 162 interconnected to motor support plates 164 secured to the main mill housing assembly 14.

The belt and pulley assembly 154 includes a main pulley assembly 166 interconnected to the motor member 160 and a belt assembly 168. The pulley assembly 166 includes a first drive pulley member 170 mounted within bearing members 174 and interconnected to a motor drive shaft 176 driven by the motor member 160.

The belt assembly 168 includes a plurality of belt members 180 mounted about the first drive pulley member 170 and the driven pulley member 172 to transfer power from the rotating motor drive shaft 176 driven by the motor member 160. The size of the pulley members 170 and 172 can be selected to regulate the resultant rotation speed of the main power shaft assembly 156.

The main power shaft assembly 156 includes a main driven shaft member 182 having a lower end section 184 mounted within a lower support bearing 188 and an upper end section 186 mounted within an upper support bearing 178. The main driven shaft member 182 is of heavy duty construction which is necessary in order to support and rotate the impact blade assemblies 64, 65, 66, and 67. This rotation creates a gyroscope action to maintain the driven shaft member 182 in a vertical plane.

The lower support bearing 188 is secured by nut and bolt members 190 to a support frame 191 secured to the bottom wall member 28 of the main mill housing assembly 14 as noted in FIG. 2.

As noted in FIG. 1, the material conveyor means 18 includes 1) a refuse inlet conveyor assembly 192 operable to initially convey the waste/trash material to be treated into the main mill housing assembly 14 along with inlet air flow; 2) a heavy infraction discharge assembly 194 having a portion thereof mounted on an upper portion of the main mill housing assembly 14 about the upper discharge opening 50; and 3) a material discharge conveyor assembly 196 to receive the finally processed waste/trash material through the lower discharge opening 52 after being treated by the material impact means 16 in the main mill housing assembly 14.

The refuse inlet conveyor assembly 192 includes a conveyor belt member 198, a conveyor support frame 200, and an outer inlet conveyor housing 201 of U-shape. The conveyor belt member 198 is provided with an upper belt support surface 202 to support the inlet waste/trash material thereon.

The conveyor support frame 200 includes support members 204 rotatably supporting a belt support bearing member 206 at one end with the conveyor belt member 198 trained thereabout. It is noted that the inlet conveyor housing 201 operates to maintain the waste/-trash material and an inlet air supply flowing in the proper direction for movement through the material inlet opening 61 to the interior of the main mill housing assembly 14.

The heavy infraction discharge assembly 194 includes an impact discharge assembly 208 operable to receive impacted heavy particles of the waste/trash material for deposit onto a discharge conveyor assembly 210.

As noted in FIG. 3, the impact discharge assembly 208 includes a main impact housing assembly 212 secured to an outer surface of the main mill housing assembly 14 and enclosing an impingement flap assembly 214.

The impact housing assembly 212 is of a generally box shape having a top wall 216 integral with two parallel spaced side walls 218 and a front wall 220 having a lower discharge opening 221. The heavy infraction material transferred into the impact housing assembly 212 drops under gravity onto the discharge conveyor assembly 210 in a manner to be explained.

As noted in FIG. 3, the impingement flap assembly 214 includes a main flap member 222 pivotally connected along an upper edge by a flap connector assembly 224 to the main mill housing assembly 14. More particularly, the flap connector assembly 224 includes nut and bolt members 226 to secure the main flap member 222 so it can be moved outwardly when impacted by heavy material such as metal, bolts, cans, or the like.

As noted in FIG. 1, the discharge conveyor assembly 210 includes a conveyor belt member 198 being supported through a conveyor support frame 200 (not shown) and trained about a belt support bearing member 206. The conveyor belt member 198 has an upper belt support surface 202 to receive, support, and convey the heavy infraction material received thereon from the impact discharge assembly 208 for movement to a separate processing area.

The material discharge conveyor assembly 196 is similar to those previously described as having a conveyor belt member 198 with a belt support surface 202 to convey the finally processed waste/trash material from the main mill housing assembly 14. More specifically, the material discharge conveyor assembly 196 includes a conveyor support frame 200 secured to a belt support bearing member 206 about which the conveyor belt member 198 is trained.

USE AND OPERATION OF THE INVENTION

In the use and operation of the gyroscopic centrifuge and mill apparatus 12 of this invention, the main mill housing assembly 14 is placed in a vertical condition resting the bottom support assembly 20 on a support surface 227.

With the gyroscopic centrifuge and mill apparatus 12 of this invention de-energized, it is noted that the access door assembly 36 and, more specifically, the access door member 54 can be pivoted about the hinge members 56 on release of the latch member 58 to gain access to the interior of the main mill housing assembly 14. Thereupon, the operator of the equipment may adjust a vertical positioning of the respective impact blade assemblies 64, 65, 66, and 67 to a desired vertical location on the main drive shaft member 182. This is readily permitted through the use of the taper lock bushing assemblies 72 and illustrated in dotted lines by movement of the impact blade assembly 67 as shown in FIG. 2. Also, this adjustment allows for desired positioning and closeness of the respective ones of the impact blade assemblies 64, 65, and 66 relative to the adjacent respective separator shelf assemblies 68. This adjustment feature regulates a distance between the striker blade members 110 relative to a respective separator shelf assembly 68 which increases or decreases the distance therebetween. This adjustable feature regulates the size of the grinding and separation of the waste/trash material as it moves downwardly from an upper treatment or first zone 252 to a second treatment zone 254, a third treatment zone 256, and a lower fourth or final treatment zone 258.

Additionally, the respective separator shelf assemblies 68 can be provided with a central access opening 146 of various diameters which would affect the distance between the separator shelf assemblies 68 and the respective impact blade assemblies 64, 65, and 66 which is another adjustable feature to regulate the size of resultant processed waste/trash material as moving downwardly through the treatment zones 252, 254, 256, and 258.

Figure 7:
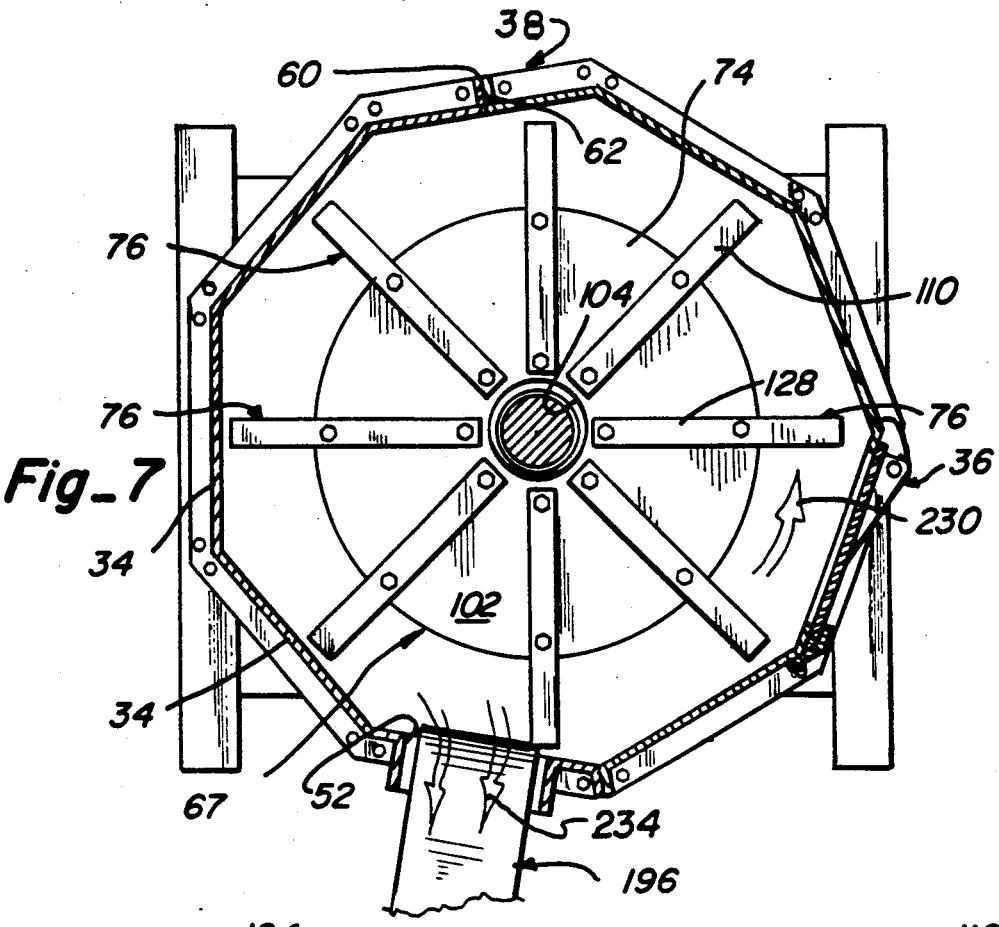
FIG. 7 is a sectional view taken along line 7—7 in FIG. 2.

Another adjustment feature of this invention is noted in FIGS. 8–10 whereupon the respective striker blade members 110 can be adjustably mounted on respective blade mounting assemblies 108 in order to increase or decrease the angular relationship of the striker blade members 110 relative to a horizontal plane. This adjustment feature is noted by comparing FIGS. 8 and 10. This adjustment noted at 132 can be between a vertical position of 90 degrees relative to the main blade support plate 74 to a horizontal position relative thereto as shown by the striker blade members 110 in FIG. 7.

The 90 degree maximum position of the striker blade members 110 relative to a respective one of the main blade bodies 102 would achieve a maximum fan impeller effect to increase the velocity and amount of air flow through the main mill housing assembly 14.

In order to commence operation, the main power supply assembly 69 is activated and the motor member 160 is energized in order to rotate the main driven shaft member 182 through use of the belt and pulley assembly 154. This then, causes a rotation of the material impact means 16 as noted by an arrow 230 in FIGS. 6 and 7.

Next, the material conveyor means 18 is energized and, more specifically, the refuse inlet conveyor assembly 192 is energized to move the conveyor belt member 198 as shown by an arrow 228. Concurrently, the discharge conveyor assembly 210 and the material discharge conveyor assembly 196 are energized in order to move the processed waste/trash material outwardly as indicated by respective arrows 232 and 234.

It is noted that the inlet conveyor housing 201 is supplied with air inlet flow being a fluid flow means under vacuum pressure as noted by an arrow 240 to assist in carrying of the inlet waste/trash material through the inlet opening 61 into the main mill housing assembly 14 of the gyroscopic centrifuge and mill apparatus 12.

Now, the material impact means 16 provides inlet conveyance air as noted by arrow 240 due to the impeller effect of the rotating striker blade members 110, and the waste/trash material is initially placed on the belt support surface 202 of the refuse inlet conveyor assembly 192 for movement noted by the arrow 228.

Next, the waste/trash material is supplied through the material inlet opening 61 to be impacted by the first stage of the treatment process in the first treatment zone 252 and, more specifically, to be acted upon by the impact blade assembly 64. At this time, any heavy infraction material 242 initially supplied will be struck by the striker blade members 110 of the impact blade assembly 64. This, then, applies an outward velocity to the heavier infraction material 242 indicated by the arrow 232 in FIG. 3. This heavier infraction material 242 thereupon impacts the main flap member 222 (being constructed of a resilient rubber material) of the impingement flap assembly 214 of the impact discharge assembly 208. As noted, this causes an upward outward movement of the main flap member 222 as noted by an arrow 244 in FIG. 3.

After impacting the main flap member 222, the heavier infraction material 242 would fall downwardly under the force of gravity onto the discharge conveyor assembly 210 for conveyance therefrom as noted by the arrow 232 in FIG. 1. The main flap 28 returns and is held in a closed, sealed condition due to 1) its resilient construction; and 2) the vacuum pressure created in the first treatment zone 252 due to the rotating impact blade assemblies 54, 65, 66, and 67 acting as fan blade impellers to pull inlet air through the inlet opening 61.

The remaining waste/trash material moves downwardly into a second treatment zone 254 having the impact blade assembly 65 therein for further impacting and grinding movement as shown by arrows 238 in FIG. 2.

The processed waste/trash material then moves downwardly into the third treatment zone 256 having the impact blade assembly 66 mounted therein. The spacing between the respective striker blade members 110 and the adjacent separator shelf assembly 68 controls the size of the processed waste/trash material as it moves downwardly in the main mill housing assembly 14 through the treatment zones 252, 254, and 256.

Furthermore, the spacing of the outer edges sections 140 of the striker blade members 110 relative to the side wall assembly 22 of the main mill housing assembly 14 will regulate the particle size of the impacted waste/trash material as it moves downwardly through the treatment zones 252, 254, and 256.

On reaching the final treatment zone 258 in the bottom area of the main mill housing assembly 14, the processed waste/trash material reaches the area having the impact blade assembly 67 mounted therein. In this area, the striker blade members 110 are generally extended in a horizontal condition and act to contact and impact the waste/trash material therein outwardly to move through the lower discharge opening 52 in a side panel member 34 as noted by the arrow 234 in FIG. 7. Of course, the processed waste/trash material is thereupon moved outwardly for further processing on the material discharge conveyor assembly 196 as noted by arrows 234 in FIGS. 1 and 7.

At this time, the processed waste/trash material can be separated by an air conveyor system into heavier and lighter particles subject to magnetic product separation, paper and plastic separation, or supplied to a processing area for use in manufacturing insulation material or the like. There are many other waste material recycling process steps that can take place with the processed waste/trash material after it passes outwardly from the material discharge conveyor assembly 196 but such is not the subject matter of this invention.

It is noted that the gyroscopic centrifuge and mill apparatus 12 of this invention is provided with numerous adjustable features such as the speed of movement of the conveyor belt member 198 of the refuse inlet conveyor assembly 192, the discharge conveyor assembly 210, and the material discharge conveyor assembly 196 to control speed of the processing operation. The speed of movement of the conveyor members needs to be considered with the air flow into the main mill housing assembly 14 as noted by arrow 240 and the rotational speed of the main driven shaft member 182 as regulated by powering through the motor member 160 and the belt and pulley assembly 154. All of these factors can be regulated and determined depending on the type, density, and volume of the waste/trash material being processed.

Furthermore, the action of processing in the treatment zones 252, 254, 256, and 258 within the main mill housing assembly 14 by the material impact means 16 can be regulated through 1) vertical adjustment of the impact blade assemblies 64, 65, 66, and 67 on the main driven shaft member 182 achieved through adjustment features of the respective taper lock bushing assemblies 72; 2) vertical adjustment of the separator shelf assemblies 68 relative to the impact blade assemblies 64, 65, and 66; 3) length adjustment features of the respective striker blade members 110 relative to the side wall assembly 22 of the main mill housing assembly 14 which will regulate particle size created by moving through the respective treatment zones; and 4) angular adjustment of the striker blade members 110 to increase and decrease the velocity and volume of air flow from the material inlet opening 61 outwardly to the material lower discharge opening 52.

Additionally, use of the impact discharge assembly 208 in conjunction with the impact blade assembly 64 is a new and novel feature of this invention. In this treatment zone 252, the impact blade assembly 64 rotates to strike heavy infraction particles 242 for movement through the impingement flap assembly 214 and onto the discharge conveyor assembly 210. This process step initially removes the potentially dangerous, harmful, and heavy material from further processing in treatment zones 254, 256, and 258 to increase equipment life.

In the method of use of the gyroscopic centrifuge and mill apparatus 12 of this invention, the steps involved are 1) adjusting the impact blade assemblies 64, 65, 66, and 67 within the main mill housing assembly 14 to determine the amount of material processing to be achieved in the treatment zones 252, 254, 256, and 258; 2) energizing the material impact means 16 to rotate the impact blade assemblies 64, 65, 66, and 67 within the main mill housing assembly 14; 3) energizing the material conveyor means 18 being operable to both supply and transfer away the waste/trash material to the main mill housing assembly 14; 4) placing raw waste/trash material on the material conveyor means 18 to inject same into an upper inlet opening 61 in the main mill housing assembly 14; 5) allowing for an inlet air flow created by the rotating material impact means 16 at the upper inlet opening 61 to convey the waste/trash material through the main mill housing assembly 14; 6) processing the waste/trash material within successive treatment zones 252, 254, 256; and 258; and 7) removing the processed waste/trash material laterally of the main mill housing assembly 14 by the material conveyor means 18.

The method of use of this invention may involve the further steps of 1) removing heavy infraction particles 242 from the first or initial treatment zone 252; 2) conveying the removed heavy infraction particles 242 laterally of the main mill housing assembly 14 by the material conveyor means 18; 3) reversing the striker blade members 110 of the impact blade assemblies 64, 65, 66, and 67 to double the useful life thereof; 4) adjusting the angular inclination of the striker blade members 110 relative to a horizontal plane to regulate the air flow volume and velocity through the main mill housing assembly 14; and 5) adjusting the rotation speed of the material impact means 16 relative to the amount of inlet waste/trash material and inlet air flow to achieve the ultimate end product being processed waste/trash material.

Another novel feature of this invention is the creation of variable air flow through the main mill housing assembly 14 from available air at the inlet conveyor housing 201 indicated at arrow 240. The rotating striker blade members 110 of the impact blade assemblies 54, 65, 66, and 67 act as blade impellers to create a continuous air flow from the inlet opening 61 until discharged with the processed waste/trash material at the lower discharge opening 52. All of the striker blade members 110 can be adjusted about a respective horizontal axis to increase the air flow volume and velocity through the main mill housing assembly 14 without the necessity of an external blower assembly.

It is noted that the gyroscopic centrifuge and mill apparatus of this invention is sturdy in construction; reliable in operation; automatic and continuous in operation; and substantially maintenance free. Furthermore, the gyroscopic centrifuge and mill apparatus is provided with numerous adjustable features thereon to control the amount of waste/trash material being processed in a given time period; control the particle separation in process steps to achieve the desired final processing of the waste/trash material as it moves downwardly within the main mill housing assembly; and providing means to control the air flow volume and velocity which affects the speed of processing and the particle size of the finally discharged processed waste/trash material. The control of the air flow volume and velocity acts to dry out and remove odors from the waste/trash material during processing in the treatment zones.

While the invention has been described in conjunction with preferred specific embodiments thereof, it will be understood this description is intended to illustrate and not to limit the scope of the invention, which is defined by the following claims:

I claim:

1. A gyroscopic centrifuge and mill apparatus operable to receive, process, impact, separate, and discharge waste/trash material, comprising:

a) a main mill housing assembly to receive and process the waste/trash material therein;

b) a material impact means mounted within said main mill housing assembly to impact and separate the waste/trash material;

c) said material impact means having a plurality of impact blade assemblies mounted in spaced adjacent relationships on a drive means for rotation therewith;

d) each of said impact blade assemblies are independently and selectively adjustable vertically relative to each other and laterally to an adjacent inner wall of said main mill housing;

e) one of said impact blade assemblies rotates to impact heavy infraction material in the waste/trash material and continuously discharge the heavy infraction material outwardly of said main mill housing assembly through a heavy infraction discharge assembly; and f) material movement means operable to supply the waste/trash material to said main mill housing assembly and transfer processed waste/trash material outwardly of said main mill housing assembly.

2. A gyroscopic centrifuge and mill apparatus as described in claim 1, wherein:

a) each of said impact blade assemblies having a taper lock bushing assembly connected to said drive means; and b) said taper lock bushing assemblies are selectively independently axially vertically adjustable on said drive means so as to achieve variation in the impact and grinding of the waste/trash material.

3. A gyroscopic centrifuge and mill apparatus as described in claim 1, wherein:

a) each of said impact blade assemblies includes 1) a bushing assembly mounted on said drive means; 2) a blade support plate connected to said bushing assembly; and 3) a striker blade assembly secured to said main blade support plate;

b) said bushing assembly adjustable axially on said drive means;

c) said striker blade assembly includes a blade mounting assembly having a striker blade member mounted thereon;

d) said striker blade member is independently adjustably mounted on said blade mounting assembly to vary the overall length thereof in proximity to an inner surface of said main mill housing assembly;

e) each of said impact blade assemblies is adjustable independently inwardly and outwardly from said drive means to vary distance from said inner wall of said mill housing assembly and f) said striker blade member is adjustably mounted on said blade mounting assembly to adjust an inclination about a horizontal axis to control the velocity and volume of air flow through said main mill housing assembly created by rotation of said material impact means.

4. A gyroscopic centrifuge and mill apparatus as described in claim 1, wherein:

a) certain ones of said impact blade assemblies operably associated with a separator shelf assembly;

b) said impact blade assemblies, each provided with a plurality of said striker blade assemblies associated with and vertically adjustable relative to a respective one of said separator shelf assemblies to cooperate in treatment zones of material processing to achieve an adjustable desired processing of the waste/trash material moving through subject treatment zones; and c) a lowermost one of said impact blade assemblies including striker blade members extended in a generally horizontal plane and having outer ends thereof positioned adjacent said inner wall of said main mill housing assembly in order to strike and impact the processed waste/trash material and move the same laterally of said main mill housing assembly through and into a discharge opening for further processing thereof.

5. A gyroscopic centrifuge and mill apparatus operable to receive, process, impact, separate and discharge waste/trash material, comprising:

a) a main mill housing assembly to receive and process the waste/trash material in a plurality of treatment zones;

b) a material impact means mounted within said main mill housing assembly to impact, separate, and process the waste/trash material in respective zones of said treatment zones;

c) said material impact means includes an impact blade assembly mounted on a drive means and a separator shelf assembly connected to said main mill housing assembly in each of said treatment zones operably associated with respective ones of said impact blade assemblies;

d) each of said impact blade assemblies adjustably mounted on said drive means to independently and adjustably preset a vertical distance between respective sets of said impact blade assemblies and said separator shelf assembly to regulate the particle size of the waste/trash material moving from one of said treatment zones to an adjacent one of said treatment zones; and e) said separator shelf assemblies adjustably mounted on said main mill housing assembly for independent and individual adjustment relative to said impact blade assemblies to achieve multiple and infinite adjustment in said main mill housing assembly; and f) each of said separator shelf assemblies operable to be adjustably movable independently relative to an adjacent cooperating one of impact blade assemblies to regulate independently the distance therebetween and, thus, regulate the particle size of the waste/trash material created in each of said treatment zones.

6. A gyroscopic centrifuge and mill apparatus as described in claim 5, wherein:

a) each of said impact blade assemblies having a striker blade assembly secured to a bushing assembly which, in turn, is adjustably connected and axially movable on said drive means;

b) each of said striker blade assemblies include a blade mounting assembly having striker blade members mounted thereon; and c) each of said striker blade members of variable lengths and can be secured at various angular relationships on said blade mounting assembly in order to 1) increase or decrease the volume and velocity of air flow through said main mill housing assembly; and 2) to regulate the positioning of an outer edge of said striker blade member relative to said main mill housing assembly to regulate a particle size created in a respective one of said treatment zones.

7. A gyroscopic centrifuge and mill apparatus as described in claim 5, including:

a) a material movement means having a material conveyor means with a heavy infraction discharge assembly;

b) said heavy infraction discharge assembly includes an impact discharge assembly associated with the uppermost first one of said treatment zones and a material discharge conveyor assembly;

c) said infraction discharge assembly includes an impact discharge assembly connected to said main mill housing assembly and operably associated with said material discharge conveyor assembly;

d) said impact discharge assembly includes an impact housing assembly and an impingement flap assembly mounted therein;

e) said impact housing assembly having an open bottom wall portion; and f) said impingement flap assembly having a main flap member which, when hit by heavy infraction material separated from the waste/trash material, contacts said main flap member to open same for discharge outwardly and downwardly therefrom.

8. A gyroscopic centrifuge and mill apparatus operable to receive, process, impact, separate, and discharge waste/trash material, comprising:

a) a main mill housing assembly having a central cavity, a material inlet opening, and a material discharge opening;

b) a material impact means mounted within said central cavity, said material impact means having a rotatable impact blade assembly mounted for rotation on a drive means and associated with a separator shelf assembly;

c) said separator shelf assembly adjustably mounted on said main mill housing assembly for infinite adjustment relative to said material impact means, said material inlet opening, and said material discharge opening;

d) said impact blade assembly vertically adjustable relative to said separator shelf assembly on said drive means to regulate and adjust a particle size of the waste/trash material to be dispensed through said material discharge opening; and e) a fluid flow means for contacting and conveying the waste/trash material from said material inlet opening, through said central cavity, and discharge same through said material discharge opening.

9. A gyroscopic centrifuge and mill apparatus as described in claim 8, including:

a) said fluid flow means operable to allow an air flow through said inlet opening pulled inwardly under vacuum pressure by rotation of said impact blade assembly to contact and move the waste/trash material through said main mill housing assembly;

b) said impact blade assembly having a bushing assembly; a blade support plate secured to said bushing assembly; and a plurality of spaced striker plate assemblies secured to said main blade support plate;

c) each of said striker blade assemblies inlcude a blade mounting assembly having a striker blade member mounted therein; and d) each of said striker blade members is adjustably mounted about a horizontal plane on respective ones of said blade mounting assemblies to act as an air flow blade member and, thus, to regulate and increase air flow received from said material inlet opening for subsequent discharge through said material discharge opening.

10. A gyroscopic centrifuge and mill apparatus as described in claim 8, wherein:

a) a material movement means includes an impact discharge assembly connected to said main mill housing assembly; and b) said impact discharge assembly having a flexible normally closed impingement flap assembly movable to an open condition when impacted by heavy materials from the waste/trash material.

11. A gyroscopic centrifuge and mill apparatus as described in claim 10, wherein:

a) said impingement flap assembly seals with said main mill housing assembly in a closed condition under vacuum pressure to prevent air loss and, in the open condition on impact, allows the heavy material to discharge downwardly out of said central cavity.

12. A gyroscopic centrifuge and mill apparatus as described in claim 10, wherein:

a) said material movement means includes 1) an inlet conveyor assembly to move the waste/trash material to said material inlet opening for continuous supply to said central cavity; 2) a discharge conveyor assembly operably associated with said impact discharge assembly to transfer the heavy materials therefrom; and 3) a material discharge conveyor assembly operably associated with said material discharge opening to receive the processed waste/trash material from said central cavity.

13. A method of using a gyroscopic centrifuge and mill apparatus to receive, process, impact, separate, and discharge waste/trash material, said gyroscopic centrifuge and mill apparatus having 1) a main mill housing assembly; 2) a material impact means mounted within said main mill housing assembly connected to a drive means; 3) said material impact means including impact blade assemblies operably associated with respective separate shelf assemblies; and 4) a material movement means operable to supply waste/trash material to said main mill housing assembly and to transfer same after processing laterally therefrom, comprising the following steps:

a) supplying the waste/trash material to said main mill housing assembly by said material movement means;

b) rotating said material impact means to contact the waste/trash material by said impact blade assemblies in separate treatment zones to impact and separate the waste/trash material into predetermined particle sizes;

c) impacting the waste/trash material in a final treatment zone and ejecting same laterally of said main mill housing assembly for movement therefrom by said material movement means; and d) adjusting vertical spacing by separate independent adjustment between said impact blade assemblies and said separator shelf assemblies to determine the particle size of the waste/trash material to be obtained in each treatment zone.

14. A method of treating waste/trash material as described in claim 13, including:

a) adjusting an angular relationship between said striker bar members and a horizontal plane to regulate and adjust air flow volume and velocity through said main mill housing assembly.

15. A method of treating waste/trash material as described in claim 13, including:

a) removing continuously heavy infraction material from an initial treatment zone; and b) conveying continuously the heavy infraction material laterally of said main mill housing assembly on said material movement means.

16. A gyroscopic centrifuge and mill apparatus operable to receive, process, impact, separate, and discharge waste/trash material, comprising:

a) a main mill housing assembly to receive and process the waste/trash material therein;

b) a material impact means mounted within said main mill housing assembly to impact and separate the waste/trash material;

c) said material impact means having a plurality of impact blade assemblies mounted in spaced relationship on a drive means for rotation therewith;

d) a separator shelf assembly mounted for vertical adjustment on said main mill housing assembly adjacent respective ones of said impact blade assemblies; and e) each of said impact blade assemblies are independently and selectively vertically adjustable relative to each other, to an adjacent inner wall of said main mill housing and respective ones of said separator shelf assemblies.

17. A gyroscopic centrifuge and mill apparatus as described in claim 16, wherein:

a) each of said impact blade assemblies includes 1) a bushing assembly mounted on said drive means; 2) a blade support plate connected to said bushing assembly; and 3) a striker blade assembly secured to said main blade support plate;

b) said bushing assembly adjustable axially on said drive means;

c) said striker blade assembly includes a blade mounting assembly having a striker blade member mounted thereon; and d) said striker blade member is adjustably mounted on said blade mounting assembly to adjust an inclination about a horizontal axis to control the velocity and volume of air flow through said main mill housing assembly created by rotation of said material impact means.

18. A gyroscopic centrifuge and mill apparatus as described in claim 16, wherein:

a) each of said impact blade assemblies having a striker blade member adjustably mounted about a horizontal plane to act as an adjustable air flow blade member to regulate air flow and movement of the waste/trash material through said main mill housing assembly by infinite adjustment.

19. A gyroscopic centrifuge and mill apparatus as described in claim 16, wherein:

a) one of said impact blade assemblies rotates to impact heavy infraction material in the waste/trash material and discharge any heavy infraction material outwardly of said main mill housing assembly through a heavy infraction discharge assembly being automatically conveyed laterally of said main mill housing assembly.

20. A gyroscopic centrifuge and mill apparatus operable to receive, process, impact, separate, and discharge waste/trash material, comprising:

a) a main mill housing assembly to receive and process the waste/trash material therein;

b) a material impact means mounted within said main mill housing assembly to impact and separate the waste/trash material;

c) said material impact means having a plurality of impact blade assemblies mounted in spaced relationship on a drive means for rotation therewith; and d) each of said impact blade assemblies includes striker blade members which are adjustable about a horizontal plane to various angular relationship to regulate volume and velocity of air flow through said main mill housing assembly.

* * * * *